US007100776B2

(12) United States Patent
Berfield

(10) Patent No.: US 7,100,776 B2
(45) Date of Patent: Sep. 5, 2006

(54) WALL MOUNTED TOOL HOLDER

(76) Inventor: Robert C. Berfield, 3681 Nichols Run Rd., Jersey Shore, PA (US) 17740-8600

( * ) Notice: Subject to any disclaimer, the term of this patent is extended or adjusted under 35 U.S.C. 154(b) by 358 days.

(21) Appl. No.: 10/792,159

(22) Filed: Mar. 3, 2004

(65) Prior Publication Data

US 2005/0194332 A1 Sep. 8, 2005

(51) Int. Cl.
*A47F 7/00* (2006.01)

(52) U.S. Cl. ..... 211/70.6

(58) Field of Classification Search ..... 211/70.6, 211/72, 73

See application file for complete search history.

(56) References Cited

U.S. PATENT DOCUMENTS

| | | | | |
|---|---|---|---|---|
| 58,089 | A | 6/1921 | Gulick | |
| 1,955,252 | A * | 4/1934 | Palls | 206/762 |
| 2,572,797 | A | 10/1951 | Zimmer | 211/87 |
| 2,688,408 | A * | 9/1954 | Binggely | 211/13.1 |
| 2,805,777 | A | 9/1957 | Larson | 211/60 |
| 2,995,256 | A | 8/1961 | Schoenfisch | 211/60 |
| 3,298,531 | A * | 1/1967 | Wilcke | 211/70.6 |
| 4,264,013 | A | 4/1981 | Vollmer | 211/13 |
| 4,318,486 | A | 3/1982 | Bobrowski | 211/87 |
| 4,653,637 | A | 3/1987 | Wallace | 206/372 |
| 4,906,058 | A | 3/1990 | Turner | 312/245 |
| 5,029,792 | A | 7/1991 | Desjardins | 248/309.1 |
| 5,071,012 | A | 12/1991 | Jailor | 211/13 |
| 5,199,578 | A * | 4/1993 | Pendergraph et al. | 211/72 |
| 5,513,416 | A | 5/1996 | Bassler et al. | 15/323 |
| 5,641,079 | A | 6/1997 | Schmidt | 211/70.6 |
| D413,471 | S | 9/1999 | Romeo | D6/567 |
| 6,375,018 | B1 | 4/2002 | Clement | 211/85.2 |

* cited by examiner

*Primary Examiner*—Sarah Purol
(74) *Attorney, Agent, or Firm*—Hooker & Habib, P.C.

(57) ABSTRACT

A holder for vacuum cleaner tools includes a flat plastic body mounted on a wall or between exposed studs on a wall with a panel bowed outwardly from the wall. The panel has a plurality of upwardly extending fingers to receive and hold vacuum cleaner tools.

45 Claims, 6 Drawing Sheets

WALL MOUNTED TOOL HOLDER

FIELD OF THE INVENTION

The invention relates to a wall-mounted holder for vacuum cleaner tools and the like.

DESCRIPTION OF THE PRIOR ART

Vacuum cleaners are common household, shop, and outdoor tools. Many vacuum cleaners have a body containing an air pump and a depository for debris. The body is connected to a hose used to draw air and debris into the machine. Specialized cleaning tools are attached to the free end of the hose, such as brushes, crevice tools, and rug cleaners to facilitate cleaning tasks.

The hoses come in a variety of sizes, commonly from 1.25 inches to 2.5 inches in diameter. Some hoses are measured in metric units. Smaller diameter hoses are preferred for collecting liquid debris and interior house cleaning, while larger diameter hoses are useful for collecting larger debris found in a workshop or outdoors.

The specialized cleaning tools attached to a hose must match the diameter of the hose. Vacuum cleaners that use hoses of different diameters have a set of tools for use with each hose. One vacuum cleaner can use a number of different size hoses and many tools.

Storage of vacuum cleaner hoses and tools is difficult. The hoses are long and intentionally non-collapsible. The tools have irregular shapes and different sizes. Some vacuum cleaners bodies have a structure that allows tools to be attached to the vacuum cleaner body. Tools attached to a vacuum cleaner body complicate use of the cleaner by increasing the exterior size of the cleaner. The tools can become dislodged during use of the cleaner and can obstruct access to the body when changing the refuse receptacle or servicing the vacuum.

The difficulty of mounting tools and hoses on the vacuum cleaner body makes it desirable to store tools in the area where they are likely to see use but not on the cleaner body.

Storage racks for vacuum cleaner tools are known. The racks may be wall mounted or mounted on the vacuum cleaner body. Some of these racks are constructed from a frame made of wire or other material. The racks are large, expensive and complicated to produce and assemble. They cannot be stored compactly, a feature desirable for reducing packaging and transport cost. Often, conventional racks are not designed to accept specialized tools of different sizes and types.

There is additional difficulty when vacuum cleaner tools and hoses are stored in rooms with unfinished walls having exposed studs, such as closets, basements or garages. These rooms lack a continuous flat mounting surface. Conventional wall racks are difficult to mount on walls with exposed studs and do not make efficient use of available space between studs.

Therefore, there is need for a wall mounted holder for vacuum cleaner tools and hoses that is inexpensive to produce, easy for a user to assemble, and mountable on either a flat surface or a wall having exposed wall studs. The holder should accommodate vacuum cleaner tools and hoses of various sizes and types and should be compact for efficient shipping and pre-sale display.

SUMMARY OF THE INVENTION

The invention is a wall mounted tool holder adapted to be mounted on a flat wall or an unfinished wall with exposed studs to hold vacuum cleaner tools of different types and sizes and accompanying vacuum cleaner hoses. The holder can be made from a flat injection-molded preform made from thermo-plastic with reduced thickness hinges and break away pieces attached to a central panel. The holder can be easily and inexpensively molded. The flat pre-form is efficiently stacked permitting inexpensive packaging, transport and pre-sale display.

In a preferred embodiment, the holder is mounted to a flat wall surface though use of a pair of triangular supports. The holder can also be mounted on a wall between exposed wall studs.

The holder has a central panel that can be flexed when mounted on a wall or between studs. This flexibility allows the panel to bow away from the wall or studs and permit mounting of the holder between studs not spaced apart an exact distance. Tools are held behind the bowed panel.

The panel has a number of upwardly pointing fingers that grip and hold vacuum cleaner tools. The fingers hold tools that have a variety of diameters measured in either metric or English units. The cylindrical hose-mountable ends of tools to be stored are positioned between the central panel and the wall and are lowered over fingers flexed from the panel toward the wall. The fingers engage the tool ends and clamp the tools against the panel. Tools are held so that the non-clamped ends extend up from the fingers. The holder may also be equipped with tool directing straps that help support the upper portions of longer tools and a hose strap for hanging vacuum cleaner hoses under the panel.

The tool holder of the present invention allows a user to store vacuum cleaner tools of different diameters and any hoses used with the vacuum cleaner. There is no need for multiple holders that are each dedicated to hold accessories of one diameter.

The tool holder can be easily mounted on either a flat wall or a wall having exposed studs in a location convenient to their use. This facilities tool organization and eases cleaning tasks.

Other objects and features of the invention will become apparent as the description proceeds, especially when taken in conjunction with the accompanying six sheets of drawings illustrating three embodiments of the invention.

DESCRIPTION OF THE PREFERRED EMBODIMENTS

Figure 11:
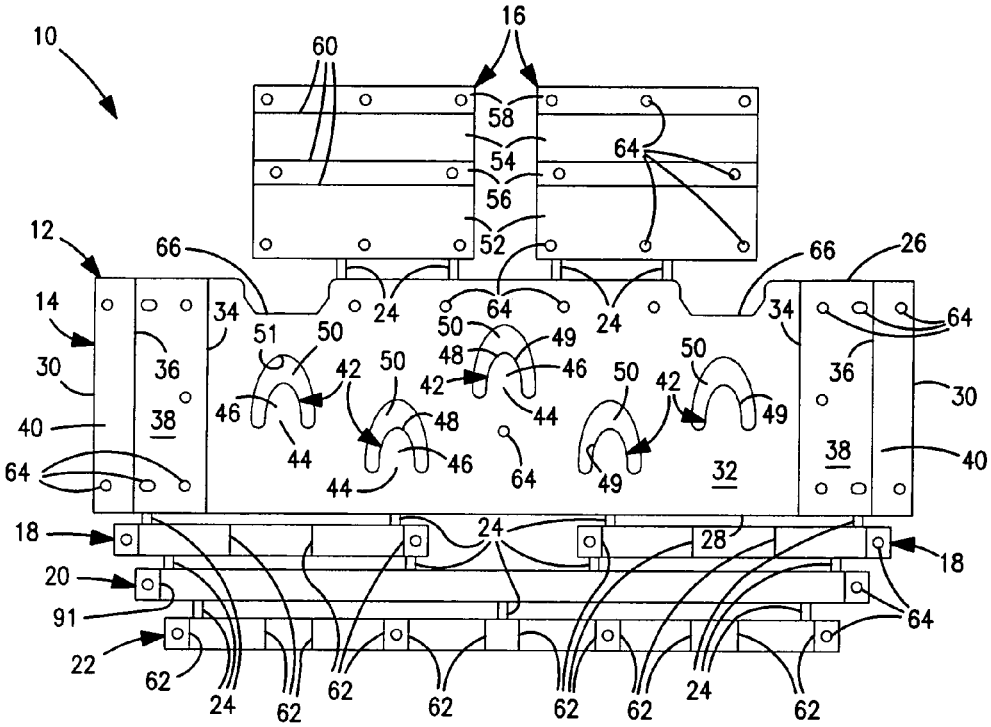
FIG. 11 is a view of a flat pre-form.

Preform 10 illustrated in FIG. 11 is formed from an integral body 12 of stiffly flexible thermo-plastic, which may be polypropylene. The preform is generally flat and includes a rectangular tool holder preform 14, a pair of like support preforms 16, a pair of like short tool support strips 18, a long hose support strip 20 and a long tool support strip 22. The preform members are preferably joined together by a plurality of integral plastic joints 24. The components of the tool holder are separated from each other at joints 24 prior to assembly and mounting of the holder as described below.

Tool holder 14 of preform 10 is rectangular in shape having spaced, parallel top and bottom edges 26 and 28 and spaced parallel ends 30 extending between edges 26 and 28. The body has a uniform thickness defining a flat, rectangular central or finger panel 32 located between the top and bottom edges and opposed inner hinges 34 extending perpendicularly between the top and bottom edges. The central panel may have a height of about 6 inches, a length of about 16 inches and a thickness of about ⅛ inch. Outer hinges 36 extend perpendicularly between the top and bottom edges of body 12 between hinges 34 and ends 30. A vertical mounting panel 38 extends between hinges 34 and 36 at each end of central panel 32. A second vertical mounting panel 40 is located between each hinge 36 and each body end 30. As illustrated in FIG. 11, panels 40 are narrower than panels 38. Hinges 34 and 36 are formed by reducing the thickness of the body 12 at the hinge to permit flexing of the adjacent panels about the hinge.

Five flat tool support fingers 42 are formed in central panel 32. Each finger includes a base 44 at the bottom of the finger integral with the central panel, a body 46 extending upwardly from the base, a tip 48 at the top of the body and a finger edge 49 extending around the finger from one end of base 44, up the finger, past tip 48 and down the other side of the finger to the other end of the base. The fingers extend upwardly with base 44 of each finger adjacent the panel bottom edge and the tip of each finger adjacent the top panel edge.

A U-shaped slot 50 extends through the thickness of panel 32 and around each finger 42 from one end of base 44 past the tip to the other end of base 44. Panel edge 51 extends around the outside of the slot. Finger edge 49 extends around the inside of the slot. The slot separates the edge of the finger from the adjacent edge of the central panel to facilitate flexing of the finger outwardly from the plane of the panel and mounting of a tool on the finger. As illustrated, the width of the top of the slot, at fingertip 48, is approximately twice the width of the lower legs of the slot at the base 44 of the finger. The increased width at the top of the slot facilitates positioning an end of a vacuum cleaner tool over the finger during mounting on the finger, as described below in further detail.

A recess 66 is formed in body top edge 26 above each of the outer fingers 42.

Each support preform 16 preferably has a uniform thickness, like the thickness of body 12, and includes horizontal arm panels 52 and 54, a mounting panel 56 located between panel 52 and 54 and an attachment panel 58 on the side of panel 54 away from panel 56. Three reduced thickness hinges 60, like hinges 34 and 36, join panels 52, 56; 56, 54; and 54, 58. Mounting panel 56 is narrower than panel 52 and 54 and the width of panels 54 and 58 approximates the width of panel 52.

A number of vertical hinges 62, like reduced thickness hinges 34 and 36, are formed in straps 18, 20 and 22 as illustrated. A plurality of mounting holes 64 are formed through the members of preform 10 at desired locations. The purpose of the mounting holes 64 is described below.

FIG. 11 illustrates preform 10 as molded with support preforms 16 located to one side of holder 14 and strips 18, 20 and 22 on the other side of the holder.

Packaging of preform 10, the support preform 16 are preferably folded 180 degrees about the joints 24 joining the preforms to holder 14 so that the support preforms overlie one side holder 14. Likewise, the strips 18, 20 and 22 are folded about the joints 24 joining strips 18 to holder 14 to position the strips on the other side of the tool holder. The folded preform comprises a three-layer stack with support preform 16 on one side of holder 14 and the strips 18, 20 and 22 on the other side of the body. The folder support preforms in the strips are connected to the tool holder by 180 degree bent joints 24 adjacent the top and bottom body edges 26 and 28.

Figure 1:
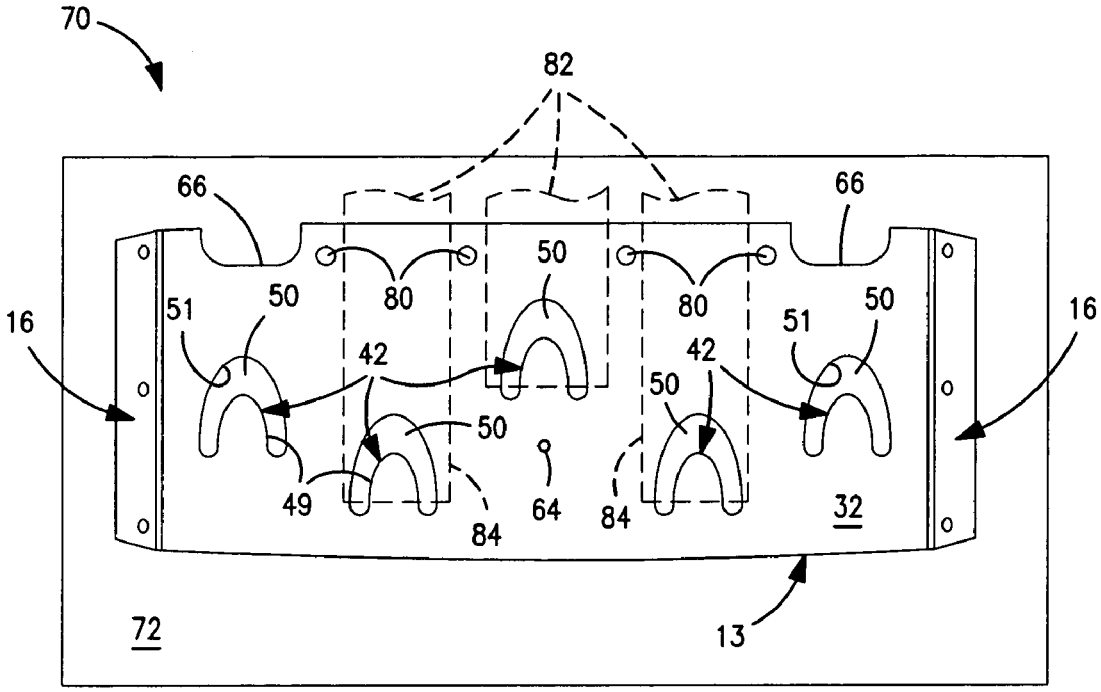
FIG. 1 is a front view of a first embodiment tool holder mounted on a vertical wall.
Figure 2:
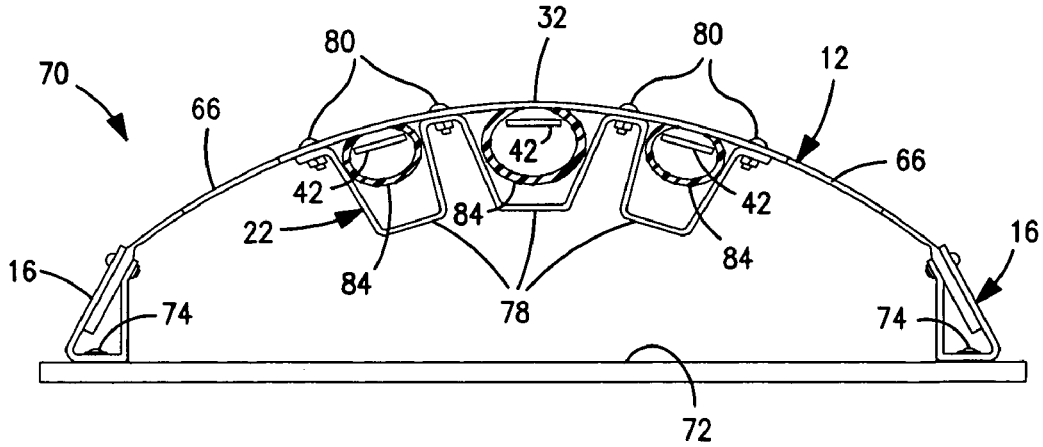
FIG. 2 is a top view of the holder shown in FIG. 1.
Figure 3:
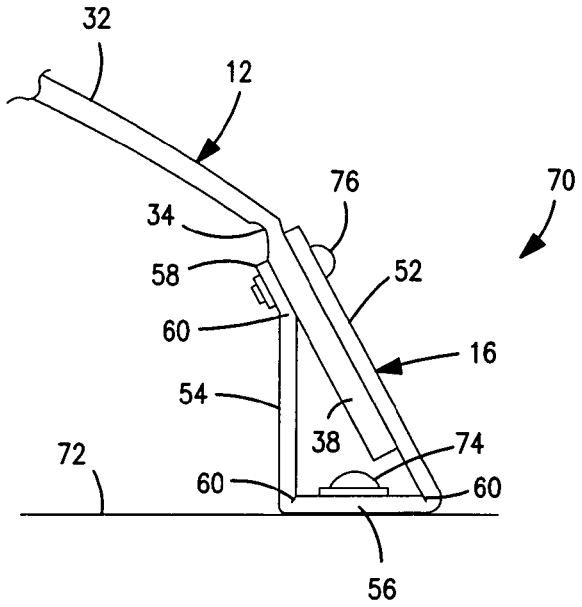
FIG. 3 is an enlarged top view of one end of the holder shown in FIG. 2.

FIGS. 1, 2 and 3 illustrate a first embodiment tool holder 70 mounted on a vertical flat or finished wall 72. Holder 70 includes a body 13 and two support preforms 16, previously described. Body 13 is identical to body 12 but without outer hinges 36 or mounting panels 40.

The holder is mounted on the wall 72 by mounting both support preforms 16 on the wall with hinges 60 extending vertically. The mounting panels 56 are then attached to the wall 72 by appropriate fasteners 74 extending through openings 64 in the vertically oriented mounting panels 56. The two mounting panels 56 are spaced apart a predetermined distance so that panel 32 is bowed out from wall 72 as illustrated.

One of the panels 38 of body 13 is positioned adjacent the mounting panel 56 of one support preform and the support preform panels 52 and 54 are bent about hinges 60 away from wall 72 to capture or sandwich panel 38 between panels 52 and 54 as shown in FIG. 3. The attachment panel 58 is bent outwardly from the adjacent edge of arm panel 54 at hinge 60 for flush engagement with panel 38. Suitable fasteners 76, which may be nut and bolt fasteners, pop rivet fastener or the like are then extended through the three sets of aligned mounting holes 64 extending through panels 52, 38 and 58 to secure the panels together and mount one end of body 13 to wall 72. Next, panel 32 is bowed outwardly from wall 72, the mounting panel 38 on the free end of the panel is positioned adjacent the second preform 16 on wall 72 and is attached to the preform as previously described to complete mounting of holder 70 on wall 72 as shown in FIGS. 1 and 2.

FIG. 2 shows support strip 22 mounted on the interior surface of panel 32 at top edge 26. Prior to mounting, strip 22 is bent about hinges 62 to form three tool support loops 78. Flat portions of the strip between the loops are attached to the inner surface of panel 32 by bolts or suitable fasteners 80 extending through mounting holes 64 formed through strip 22 and panel 32 adjacent top edge 26. Each tool support loop 78 is located above one of the three central fingers 42 formed in panel 32. Recesses 66 formed in panel top edge 26 are located above the two outer fingers 42 in panel 32. As shown in FIG. 2 the central loop 78 is larger than the end loops 78 and may support a larger tool than the tools supported by the end loops.

FIGS. 1 and 2 show three vacuum cleaner tools 82 mounted on the central three-tool support fingers 42 of holder 70. Each vacuum cleaner tool 82 includes a downwardly facing tubular end 84 and an upwardly extending work end (not illustrated). Each tool 82 is mounted on holder 70 by lowering tubular end 84 through one of the support loops 78 onto a finger 42. Tools with small diameter tubular ends can be lowered onto a finger without the need of bending the finger inwardly of the panel. For larger diameter tools, it is necessary to bend the finger 42 inwardly of the outwardly bowed panel 32 so that the lowered end 84 is confined between the finger and the inner surface of the panel, as illustrated in FIG. 2. The bent, resilient finger clamps the tool end 84 between edges 49 and 51 to hold the tool in place. Loops 78 support the upper portions of the tools so that the tools extend upwardly from the holder. Portions of the ends extend into the slots 50 extending around the fingers 42. Other vacuum cleaner tools may similarly be mounted on the outer two fingers 42 of holder 70. Lateral extensions of these tools may be seated in recesses 66.

Each tool holder has an upper and a lower continuous band 93, 95 at the top and bottom edge 26, 28 and extending fully across the holder between the ends 30. In holder 14, the bands contact with each other at line 97. Line 97 extends from one end of the holder to the adjacent finger 42, between adjacent fingers 42 and to the opposite end of the holder. If desired, the bands 93, 95 may be separated at line 97 with band 93 spaced a distance above band 95. The fingers 42 extend upwardly from the lower band 95. Upper band 93 is located over the fingers 42.

Tools with small diameter tubular ends are mounted on a tool holder by positioning the tools above a holder previously mounted on a wall or between studs and then lowering the tubular ends between band 93 and the wall and fitting each end freely over a finger 42. The tools lean inwardly toward the wall and may be supported by the wall or by a tool support loop 78 mounted on the back of the upper band 93. The upper band 93 prevents the tools mounted freely on the fingers from falling forwardly away from the wall and off the holder. In this way, tools with small diameter ends insufficiently large to be clamped between the fingers and the panel are positively held in place on the holder.

Vacuum cleaners frequently include heads that are mounted on tubular sections for cleaning floors and rugs. These heads have an elongate body and a central tubular mounting portion extending away from the body. Heads of this type may be mounted on the ends of holder 70 with one end of the head extended into the narrow space between panel 32 and wall 72 at a slot 66 and with the head seated in the slot to support the tool.

If desired, strap 20 may be formed into a loop and secured to the inner surface of panel 32 at mounting hole 64 located below central finger 42. Strap 20 forms a loop for supporting a coiled vacuum cleaner hose, as shown more clearly in the second embodiment of FIGS. 4, 5 and 6. The strap extends straight down from hole 64 and bends inwardly from the panel to form a hose support loop 89 located on the convex side of the panel, between the panel and the adjacent wall. Loop 89 supports the hose behind the panel. The hose does not extend out from the panel. Hinge 91 on the inner end of the loop is flexed to locate loop 89 inside the panel.

Figure 4:
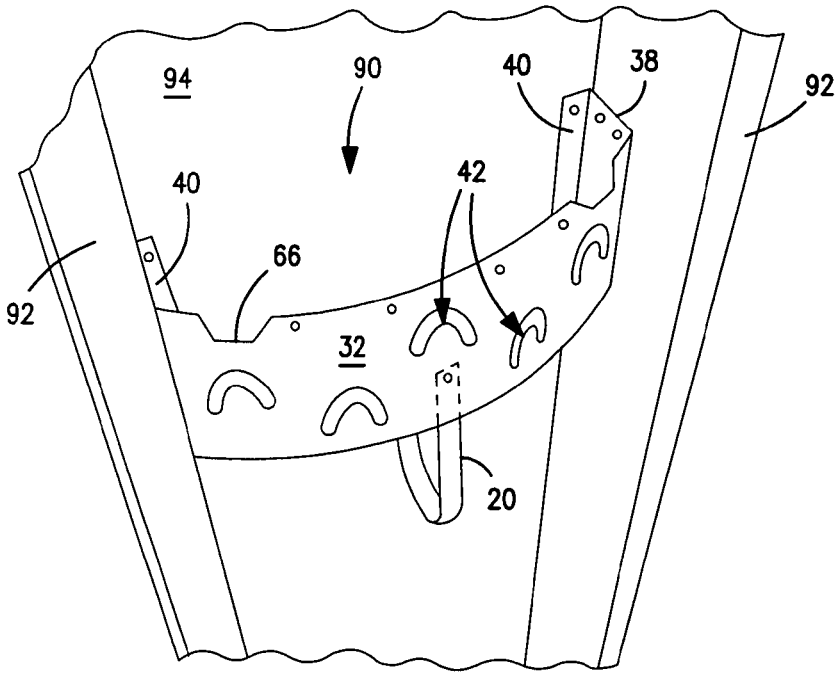
FIG. 4 is a perspective view of a second embodiment tool holder mounted on a wall between adjacent studs.
Figure 5:
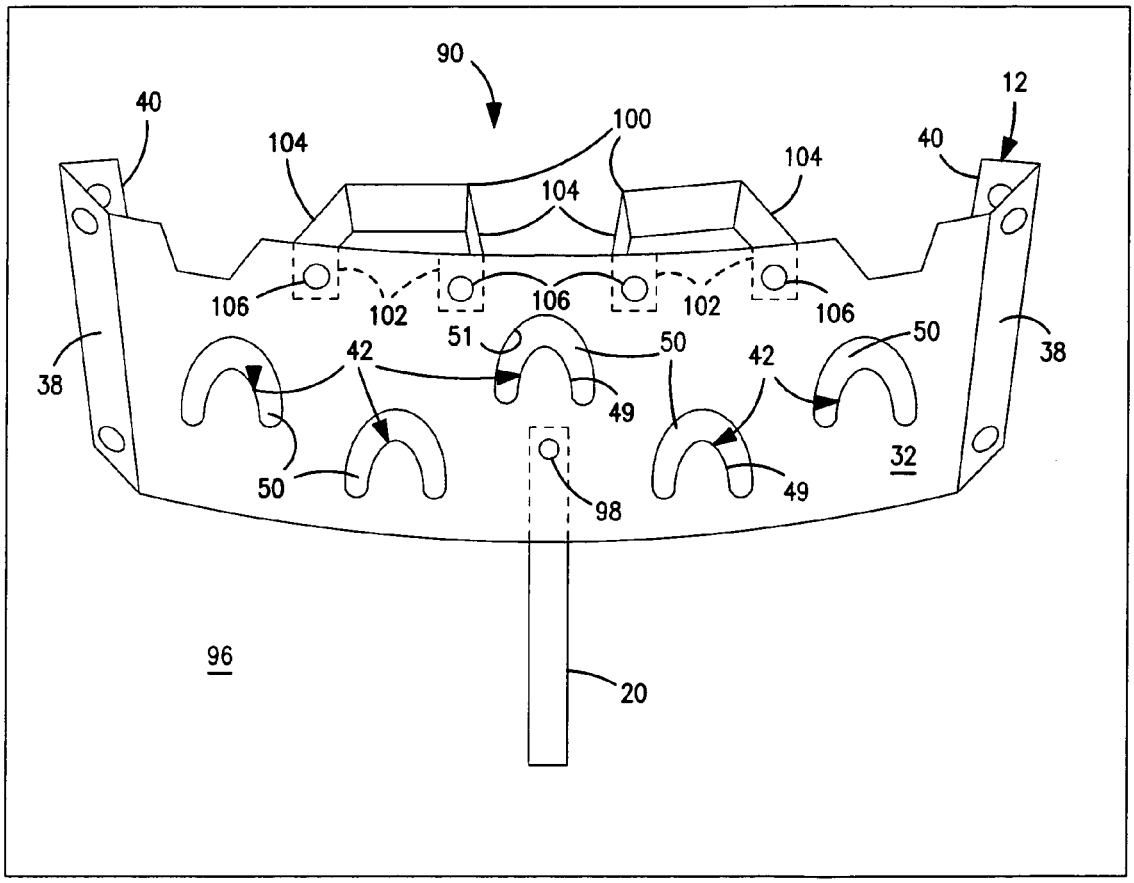
FIG. 5 is a perspective view of the second embodiment holder mounted on a flat wall.

Second embodiment tool holder 90 is illustrated in FIGS. 4–8. As shown in FIG. 4, holder 90 may be mounted between two vertical studs 92 extending to one side from unfinished wall 94. Alternatively, holder 90 may be mounted on flat finished wall 96 as shown in FIG. 5.

Holder 90 includes body 12 with a finger or central panel 32 and mounting panels 38 and 40 to each end of the central panel with hinges 34, 36 between adjacent panels, as previously described and illustrated in FIG. 11. Fingers 42 and slots 50 are formed in panel 32 as previously described. Hose support strap 20 may be mounted on panel 32 below central finger 42 by means of a fastener 98 extending through the mounting hole 64 in panel 32 and mounting holes formed in the ends of strap 20. Two short tool support straps 18 may be fastened to the inner surface of panel 32 below top edge 26 to form a pair of tool support loops 100 located above the fingers 42 to either side of central finger 42. See FIG. 5. Alternatively, wall support strip 22 may be mounted to panel 32 to form three support loops as shown in FIG. 2 and previously described. Support loops 100 are wider than loops 78 and can accommodate larger diameter tools than loops 78. This is because the mounting tabs 102 on the ends of the strips 18 join the loop sides 104 outwardly from the fasteners 106 joining the strips to panel 32. In loops 78, the loop sides join the mounting portions inwardly of the fasteners holding strip 20 to the panel.

FIG. 4 illustrates holder 90 mounted between studs 92 on an unfinished wall. Panels 38 rest flush against the interior surfaces of adjacent studs 92 and space panel 32 outwardly from wall 94. Panel 32 is bowed outwardly from wall 94. The flexibility of panel 34 accommodates mounting of the holder between adjacent studs despite variation in the spacing between the studs. Panels 40 rest flush on wall 94. The holder is mounted on the studs and wall by conventional fasteners extending through mounting holes 64 in panels 38 and 40. Support loops 78 or 100 are not shown in FIG. 4. Panels 40 are not necessary when holder 90 is mounted between studs and may be omitted, if desired.

Figure 6:
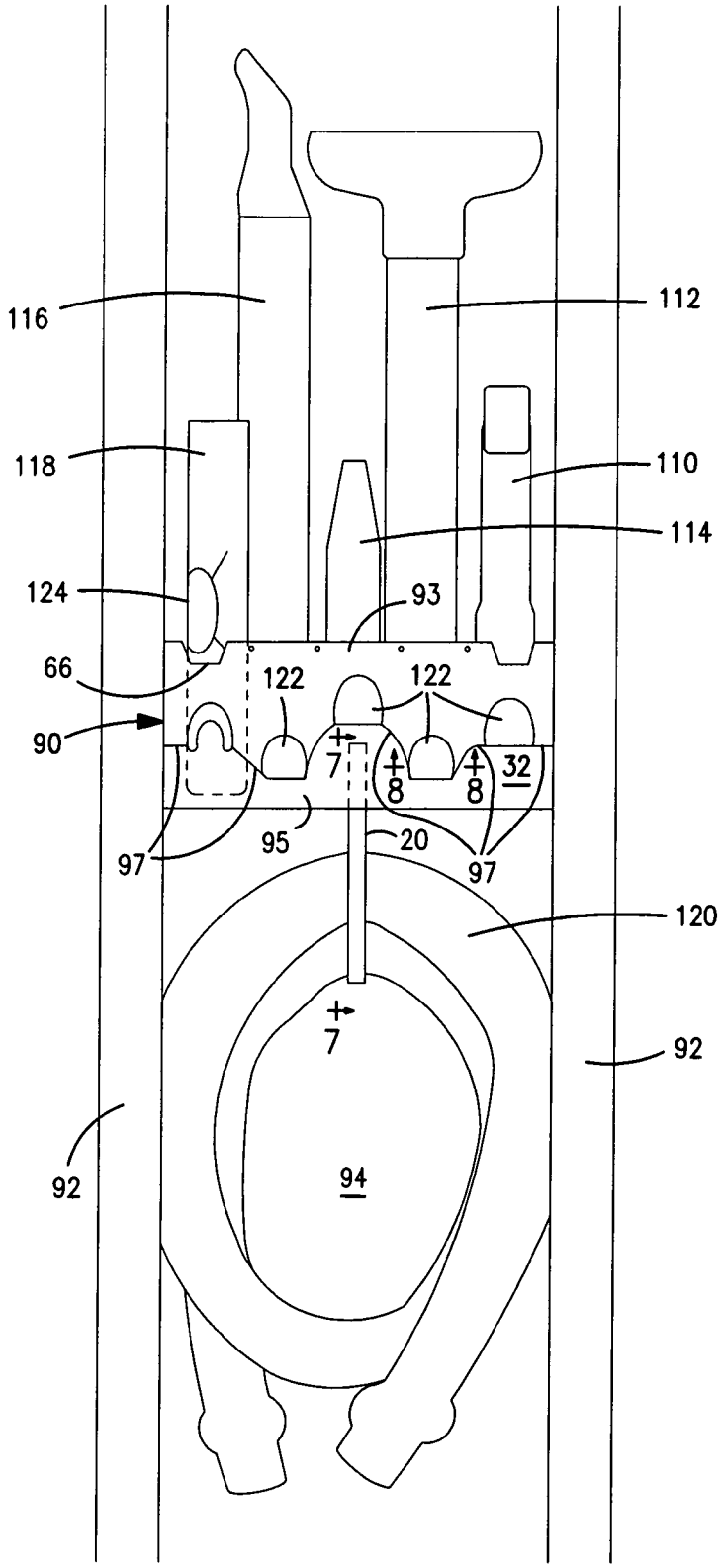
FIG. 6 is a front view of the holder shown in FIG. 4 with mounted vacuum tools and a hose on the holder.
Figure 7:
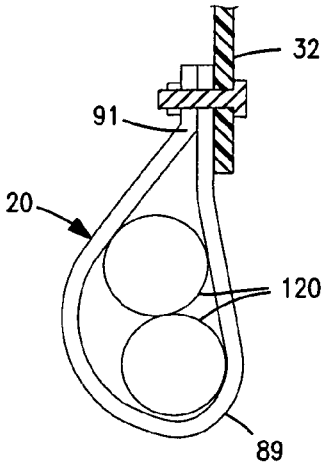
FIGS. 7 and 8 are sectional views taken along lines 7—7 and 8—8 of FIG. 6 respectively.

FIG. 6 shows a variety of vacuum cleaner tools 110–118 mounted on holder 90 and a coiled vacuum cleaner hose 120 supported by strap 20 below the holder. Elongate vacuum cleaner tools 110–116 have cylindrical lower ends 122 which are fitted over the four fingers 42 located below the tools. These tools extend through support loops mounted on the back of the top of panel 32, if provided. The ends 122 of tools 110–116 are fitted over fingers 42 and clamped between edges 49 and 51 with the portions of the ends of the tools overlying the fingers extending into the thickness of panel 32 and the portion of the tools immediately above the fingers resting on the inner surface of the panel. This arrangement tilts the tool rearwardly at an angle directly away from the bowed panel. When tools on holder 90 are viewed from the front, as in FIG. 6, the tilt of the tool held by the central finger directly toward wall 94, is not observed. However, the tools held by fingers to either side of the central finger tilt inwardly toward the center of the panel. This tilt is not illustrated in FIG. 6.

T-shaped vacuum cleaner tool 118 is fitted in the space between the left end of panel 32, adjacent stud 92, and wall 94. The side of the tool adjacent central outlet 124 seats in recess 66 to retain the tool in the holder.

Figure 8:
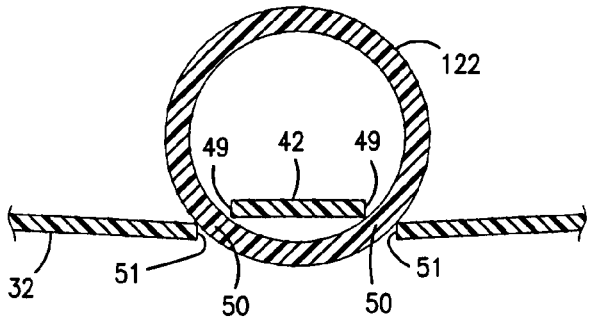

As illustrated in FIGS. 5 and 11, the slots 50 surround the fingers 42 and space the fingers from the adjacent portions of panel 32. The width of the slots facilitates insertion of the lower cylindrical ends 122 of tools over inwardly deflected fingers 42, as illustrated in FIG. 8. Without slots 50, the fingers would have to be deflected a greater distance inwardly from the panel to receive the tool ends 122.

Figure 9:
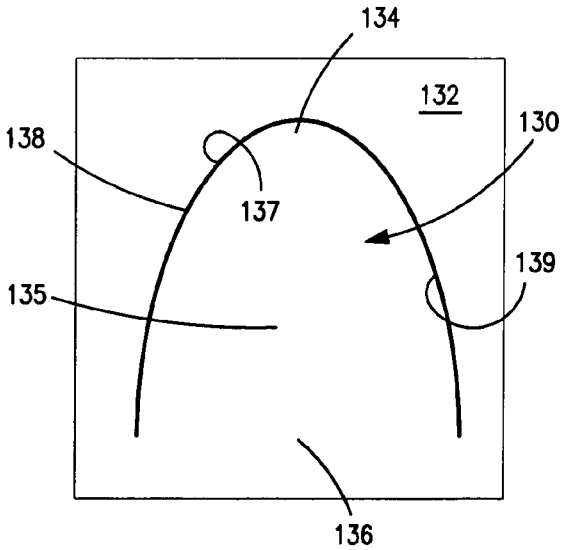
FIG. 9 is a front view of a portion of a panel illustrating a third embodiment retention finger.

FIG. 9 illustrates an alternative tool support finger 130 formed in a panel 132 which may otherwise be identical to panel 32. Finger 130 includes a tip 134 at the upper end thereof like tip 48 of finger 42, a body 135 like body 46 of finger 42, a base 136 at the lower end of the finger joining the finger to panel 132 like base 44 of finger 42 and finger edge 137, like edge 49. Finger 130 is defined by a slit 138 extending around the finger from one end of base 136 past tip 134 and to the other end of base 136. Finger edge 137 forms one side of slit 138. Panel edge 139 forms the other side of the slit. Finger 130 may be punched from panel 132 to form the slit 138.

Figure 10:
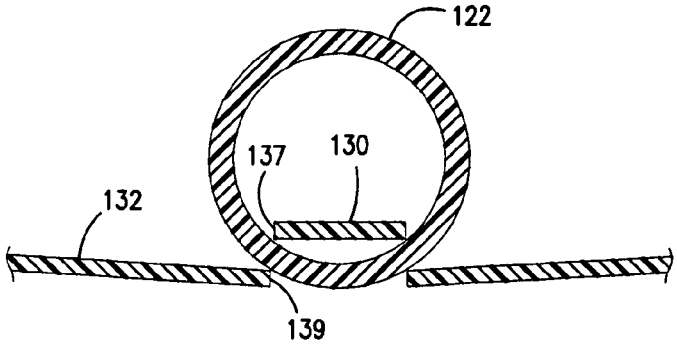
FIG. 10 is a sectional view like FIG. 8 of a tool accessory mounted on the finger of FIG. 9.

Slit 138 allows deflection of finger 130 inwardly of the panel 132 to receive a lower cylindrical end of a tool inserted over the finger, as previously described. See FIG. 10. Because the finger is separated from the panel by a slit, rather than by a slot, the finger must be deflected a greater distance inwardly from the panel to receive and clamp the lower end of the tool between edges 137 and 139. This is because edges 137 and 139 are not spaced apart by a slot as in the previously described embodiments. Compare FIGS. 8 and 10.

The tip 48 of finger 42 and tip 134 of finger 130 may be deformed, either by molding or permanent bending, beyond the inner side of the respective panel to be in position to receive the end of a tool lowered over the finger. Locating the fingertip on the inside of the panel reduces or eliminates the need to push the finger manually beyond the panel during mounting of a tool on the finger.

Figure 12:
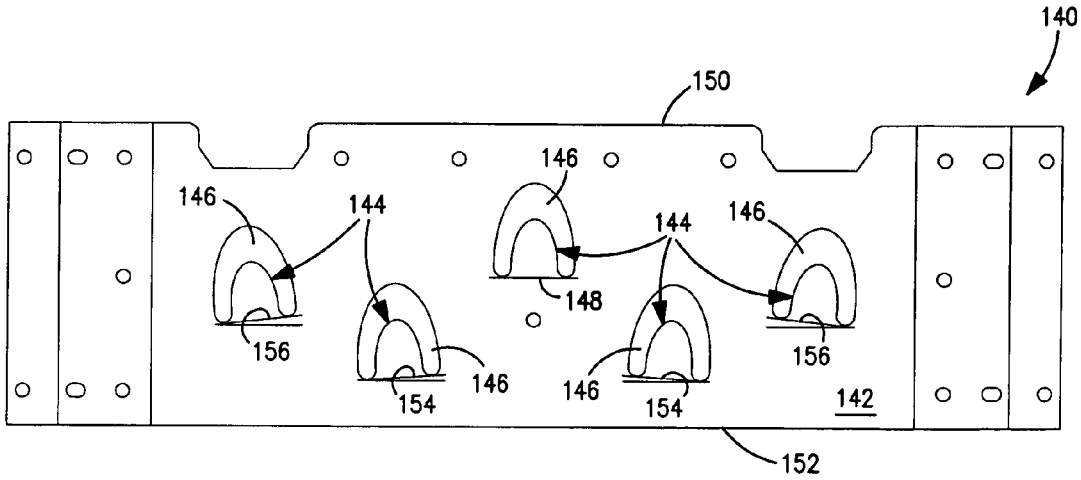
FIG. 12 is a view of a tool holder showing fourth embodiment retention fingers.

FIG. 12 illustrates a third embodiment tool holder 140 which is similar to holder 14 shown in FIG. 11. Holder 140 includes a central panel 142, like panel 32, and five tool retention fingers 144 and surrounding slots 146 having the same shape as fingers 42 and slots 50. The central finger 144 and surrounding slot 146 are identical to the finger 48 and slot 50 in the center of panel 32 with the lower ends of the slot and the base of the finger located on a horizontal line 148 parallel to the top and bottom edges 150 and 152. The fingers and slots to either side of the central finger 144 and slot 146 are tilted away from the central finger and slot proportional to the distance from the central finger and slot so that the finger bases and the lower ends of the slots lie on lines 154 and 156 with the inner end of the slot and finger base located above the outer end of the slot and finger base. The outward tilt of the outer fingers and slots is shown in FIG. 12. The outer fingers 144, adjacent the ends of panel 142 are tilted further away from the central finger and slot than the inner fingers and slots. Lines 154 are tilted about three degrees and lines 156 are tilted about six degrees.

The tilting of the outer fingers and slots assures that vacuum cleaner tools mounted on the outer fingers and slots do not tilt directly away from the inner surface of panel 142 but are tilted a small angle outwardly from the center of the panel. This small tilt assures that the tools mounted on the bowed panel 142 of holder 140 are tilted back directly toward the wall behind the holder. When viewed from the front of the holder, the tools are parallel to each other. This orientation is pleasing to the viewer and facilitates grasping and removal of the tools from the holder.

U-shaped slots 50 extend completely around fingers 42 from one end of the finger base past the tip to the other end of the finger base. These slots provide spacing between the sides of the finger and the adjacent panel sides to permit positioning of vacuum cleaner ends of the fingers with minimal inward deflection of the fingers. The lower tool ends fill the slots to either side of the finger.

If desired, the fingertips could extend upwardly to the upper edge of the panels with a slit between the fingertip and the panel and two separate slots each extending from the tip of the finger down to one end of the finger base. The finger can be deflected from the panel to receive the lower end of a vacuum cleaner tool as previously described with the end of the tool filling the lower ends of the two separate slots as shown in FIG. 8.

Holder 14 has been described with central panel 32 bowed outwardly from the wall or studs supporting the holder. If desired, the holder may be mounted on adjacent studs with panel 32 extending flat between the two studs. Vacuum cleaner tools are mounted on the tool support fingers 42 as described. There is no need to rotate the fingers and slots as illustrated in FIG. 12.

While I have illustrated and described preferred embodiments of my invention, it is understood that these are capable of modification, and I therefore do not wish to be limited to the precise details set forth, but desire to avail myself of such changes and alterations as fall within the purview of the following claims.

What I claim as my invention is:

1. A holder for vacuum cleaner tools comprising:

a central panel formed of stiffly flexible material, the central panel having a top edge, a bottom edge and opposed ends, said central panel being outwardly bowed between said ends thereof; two first end panel located at one end of the central panel; two first hinges, each hinge joining one end panel to the central panel at one end thereof, wherein the end panels may be rotated relative to a support; the central panel to facilitate attachment of the holder to a support; the central panel including at least one upwardly extending tool retention finger, each finger located in the central panel between the panel top and bottom edges and having a base joining the central panel at the bottom of the finger, a tip at the top of the finger, a flexible body extending around the finger; the central panel including a panel edge extending around each finger; each finger having an unstressed position located substantially within the central panel and a flexed position located to one side of the central panel, wherein each finger, when in the flexed position, clamps a tubular end of a vacuum cleaner tool between the finger edge and the panel edge.

2. The holder as in claim 1 including a slit extending around each finger.

3. The holder as in claim 1 including a slot at each side of each finger.

4. The holder as in claim 3 wherein the slots at one finger have lower ends located at different levels.

5. The holder as in claim 1 including two fingers; and a slot at each side of each such finger, the slots at each finger having lower ends at different levels.

6. The holder as in claim 1 including a tool support loop attached to said central panel above at least one of said fingers.

7. The holder as in claim 6 wherein said loop includes loop sides extending away from the central panel and a mounting tab on the end of each loop side adjacent said central panel; and mounting members attaching said tabs to said panel.

8. The holder as in claim 7 wherein said tabs extend inwardly toward each other.

9. The holder as in claim 7 wherein said tabs extend outwardly away from each other.

10. The holder as in claim 1 wherein said body includes two second end panels and two second hinges; each said second hinge joining one of said second end panels to one of said first end panels.

11. The holder as in claim 1 including a pair of holder supports, each holder support including a mounting panel and a pair of arm panels attached to the mounting panel;

each first end panel located between the pair of arm panels of one of said holder support members; and including attachment members securing each such first end panel to one of said holder supports.

12. The holder as in claim 1 including a vacuum cleaner hose support loop; and a loop attachment member joining the loop to the central panel, said loop located below the bottom edge of the central panel and substantially to one side of the central panel.

13. The holder as in claim 12 wherein said support loop located substantially on the concave side of the central panel.

14. The holder as in claim 1 wherein the tip of each finger is located to one side of the central panel when the finger is in the unstressed position.

15. The holder as in claim 1 wherein the central panel is about 16 inches long, about 6 inches high and about ⅛ inch thick.

16. The holder as in claim 1 wherein said material comprises a thermoplastic.

17. The holder as in claim 1 wherein said central panel, end panels and first hinges comprise an integral body of stiffly flexible thermoplastic.

18. A holder for items having tubular ends, the holder comprising a first panel formed from a stiffly flexible material, said panel including a top edge, a bottom edge and at least one upwardly extending tool retention finger located in the panel between the panel top and bottom edges, the finger having a base joining the panel at the bottom of the finger, opposed sides, a tip at the top of the finger, a flexible body extending between the base and the tip wherein the finger may be flexed to locate the tip to one side of the panel, and a finger edge extending up from the base at one side of the finger to the tip and down to the base at the other side of the finger; the panel including a panel edge extending around the finger adjacent said finger edge; each finger having an unstressed position located substantially within the panel and a flexed position with the tip located to one side of the panel, wherein the tubular end of an item positioned over a flexed finger is clamped to the panel between the finger edge and the panel edge at each side of the finger, said first panel being outwardly bowed; and each finger located on the concave side of the bowed first panel when in the flexed position.

19. The holder as in claim 18 including a slot in the panel at each side of each finger.

20. The holder as in claim 18 including a slot in the panel extending around each finger.

21. The holder as in claim 18 wherein said panel includes opposed ends, each panel end extending between said top edge and said bottom edge, and including a panel mounting member at each said panel end.

22. The holder as in claim 21 wherein each panel mounting member comprises an end panel; and including a hinge joining each end panel to the first panel, said first panel, hinges and end panels comprising an integral body of stiffly flexible thermoplastic.

23. The holder as in claim 18 wherein the tip of one finger when in the unstressed position is located to one side of the panel.

24. The holder as in claim 18 including a support preform overlying one side of the first panel; a first joint joining the support preform to the first panel; a strap overlying the other side of the first panel; and a second joint joining the strap to the first panel.

25. The holder as in claim 18 wherein said first panel, said support preform, said strap and said joints comprise an integral body of thermoplastic.

26. A holder for items having tubular ends, the holder comprising a first panel formed from a stiffly flexible material, said panel including a top edge, a bottom edge and at least one upwardly extending tool retention finger located in the panel between the panel top and bottom edges, the finger having a base joining the panel at the bottom of the finger, opposed sides, a tip at the top of the finger, a flexible body extending between the base and the tip wherein the finger may be flexed to locate the tip to one side of the panel, and a finger edge extending up from the base at one side of the finger to the tip and down to the base at the other side of the finger; the panel including a panel edge extending around the finger adjacent said finger edge; each finger having an unstressed position located substantially within the panel and a flexed position with the tip located to one side of the panel, wherein the tubular end of an item positioned over a flexed finger is clamped to the panel between the finger edge and the panel edge at each side of the finger, and a recess in said top edge located over one of said fingers.

27. A tool holder for mounting tools of the type having tubular lower ends, the holder having horizontally spaced apart ends, a bottom edge and a top edge, a lower band extending across the holder between the ends thereof at the bottom edge, an upper band extending across the holder between the ends thereof at the top edge, the upper band located above the lower band, one or more tool engaging fingers on the lower band, each finger extending upwardly from the lower band, wherein when the tool holder is mounted on a wall with the bands spaced outwardly from the wall the tubular end of a tool may be lowered from above the holder between the wall and the upper band and over a finger on the lower band so that the upper band prevents the tool holder from tipping outwardly from the wall and falling away from the holder; each band formed from thin stiffly flexible material, and each finger integral with said lower band.

28. The holder as in claim 27 wherein said upper band is located a distance above said lower band.

29. The holder as in claim 28 wherein each finger extends upwardly from the top of the lower band.

30. The holder as in claim 29 wherein said bands form part of an integral plastic panel.

31. The holder as in claim 30 wherein said bands are spaced apart vertically.

32. The holder as in claim 30 including an integral connection between the top of the lower band and the bottom of the upper band.

33. The holder as in claim 30 wherein said bands are bowed outwardly away from the wall.

34. The holder as in claim 27 wherein each finger extends upwardly from the top of the lower band and said fingers are integral with the lower panel.

35. The holder as in claim 27 including a pair of end panels, each end panel joining one end of the holder.

36. The holder as in claim 35 wherein said holder comprises a central panel; and said central and said end panels are formed from an integral body of stiffly flexible plastic.

37. The holder as is claim 36 wherein each finger includes a finger edge; and including a panel edge adjacent each finger edge; wherein the lower end of a tool mounted on a finger is held between said edges.

38. A holder for supporting tools having tubular portions; the holder comprising an integral body of stiffly flexible thermoplastic material, the body having a central panel defining horizontally spaced apart edges and including a plurality of upwardly extending tool-holding fingers, each finger having a tip at the top of the finger free of the panel and a base at the bottom of the finger, each finger joined to the panel at the base thereof; two mounting members, each mounting member joined to the panel at one panel edge thereof to mount the holder to a wall or to two adjacent studs spaced apart on a wall; wherein bowing of the panel outwardly from a wall locates the fingers a distance from the wall to permit tubular portions of tools to be positioned on the fingers so that the tools are held in generally upright positions between the bowed panel and the wall, and varying the amount of panel bow allows varying the mounting distance on the wall or to two adjacent studs on the wall.

39. The holder as in claim 38 wherein one finger is located at the top of the panel.

40. The holder as in claim 38 wherein one finger is located between the top and bottom of the panel.

41. The holder as in claim 38 wherein each mounting member comprises a mounting panel and including a plastic hinge joining each mounting panel to one central panel edge.

42. The holder as in claim 38 including a slit extending around one finger between the finger and the body.

43. The holder as in claim 38 including a slot extending around one finger between the finger and the body.

44. The holder as in claim 38 wherein said mounting members are integral with said body.

45. The holder as in claim 44 including a hinge between each mounting member and the panel.

* * * * *

UNITED STATES PATENT AND TRADEMARK OFFICE

CERTIFICATE OF CORRECTION

PATENT NO. : 7,100,776 B2
APPLICATION NO. : 10/792159
DATED : September 5, 2006
INVENTOR(S) : Robert C. Berfield It is certified that error appears in the above-identified patent and that said Letters Patent is hereby corrected as shown below:

Column 8, line 22, replace "panel located at" with --panels, each end panel located at--.

Column 8, line 26, replace "relative to" with --relative to the central panel to facilitate attachment of the holder to--.

Column 8, line 32, replace "extending around" with --extending between the base and tip, and a finger edge extending around--.

Signed and Sealed this

Twenty-eighth Day of November, 2006

JON W. DUDAS
*Director of the United States Patent and Trademark Office*